US006579405B1

(12) United States Patent
Montfort

(10) Patent No.: US 6,579,405 B1
(45) Date of Patent: Jun. 17, 2003

(54) METHOD AND APPARATUS FOR ASSEMBLING AN ULTRASONIC TRANSDUCER

(75) Inventor: David B. Montfort, Webster, NY (US)

(73) Assignee: Xerox Corporation, Stamford, CT (US)

( * ) Notice: Subject to any disclaimer, the term of this patent is extended or adjusted under 35 U.S.C. 154(b) by 170 days.

(21) Appl. No.: 09/722,231

(22) Filed: Nov. 27, 2000

(51) Int. Cl.[7] ..... H04R 31/00

(52) U.S. Cl. ..... 156/299; 156/580; 156/583.91; 29/594

(58) Field of Search ..... 156/297, 583.91, 156/560, 299, 580; 29/594

(56) References Cited

U.S. PATENT DOCUMENTS

| | | | | | |
|---|---|---|---|---|---|
| 1,447,616 | A | * | 3/1923 | Ermold | 156/560 |
| 2,639,257 | A | * | 5/1953 | Szegvari et al. | 156/310 |
| 3,454,459 | A | * | 7/1969 | Munier | 156/297 |
| 3,631,383 | A | * | 12/1971 | Zillinskas | 29/594 |
| 4,363,992 | A | | 12/1982 | Holze, Jr. | |
| 4,600,455 | A | * | 7/1986 | Doherty et al. | 156/583.91 |
| 4,713,572 | A | | 12/1987 | Bokowski et al. | |
| 5,005,054 | A | | 4/1991 | Stokes et al. | |
| 5,010,369 | A | | 4/1991 | Nowak et al. | |
| 5,016,055 | A | | 5/1991 | Pietrowski et al. | |
| 5,025,291 | A | | 6/1991 | Nowak et al. | |
| 5,030,999 | A | | 7/1991 | Lindblad et al. | |
| 5,081,500 | A | | 1/1992 | Snelling | |
| 5,210,577 | A | | 5/1993 | Nowak | |
| 5,282,005 | A | * | 1/1994 | Nowak et al. | 355/273 |
| 5,329,341 | A | | 7/1994 | Nowak et al. | |

* cited by examiner

*Primary Examiner*—Michael W. Ball
*Assistant Examiner*—John T. Haran
(74) *Attorney, Agent, or Firm*—Lloyd F. Bean, II

(57) ABSTRACT

An apparatus fabricating a resonator including a horn member and a plurality of piezoelectric members which are secured together by an adhesive layer, including a support element for holding said horn securely in place; and a plurality of clamping bars for applying a discrete force to each one of said plurality of piezoelectric members, each one of said plurality of clamping bars is in contact and associated with an individual piezoelectric member from said plurality of piezoelectric elements thereby maintaining a substantially uniform adhesive layer thickness between said horn and each of one said plurality of piezoelectric members. A pneumatic force application system connected to each one of said plurality of clamping bars for supplying said discrete uniform force to each one of said plurality of clamping bars, said pneumatic force application system includes a plurality of air cylinders, each of said plurality of air cylinders having a force applicator connected to each one of said plurality of clamping bars, a common air tank connected in parallel with each of said plurality of air cylinders to provide a common air pressure to each of said plurality of air cylinders.

3 Claims, 5 Drawing Sheets

METHOD AND APPARATUS FOR ASSEMBLING AN ULTRASONIC TRANSDUCER

The present invention is directed to a method and apparatus for assembling an ultrasonic transducer for use in electrophotographic applications.

BACKGROUND OF THE INVENTION

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder or powder suspension referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced.

Subsequent to development, excess toner left on the charge retentive surface is cleaned from the surface. The process is well known and useful for light lens copying from an original and printing applications from electronically generated or stored originals, where a charged surface may be imagewise discharged in a variety of ways. Ion projection devices where a charge is imagewise deposited on a charge retentive substrate operate similarly. In a slightly different arrangement, toner may be transferred to an intermediate surface, prior to retransfer to a final substrate. Transfer of toner from the charge retentive surface to the final substrate is commonly accomplished electrostatically. A developed toner image is held on the charge retentive surface with electrostatic and mechanical forces. A substrate (such as a copy sheet) is brought into intimate contact with the surface, sandwiching the toner thereinbetween.

An electrostatic transfer charging device, such as a corotron, applies a charge to the backside of the sheet, to attract the toner image to the sheet. Unfortunately, the interface between the sheet and the charge retentive surface is not always optimal.

Particularly with non-flat sheets, such as sheets that have already passed through a fixing operation such as heat and/or pressure fusing, or perforated sheets, or sheets that are brought into imperfect contact with the charge retentive surface, the contact between the sheet and the charge retentive surface may be non-uniform, characterized by gaps where contact has failed. There is a tendency for toner not to transfer across these gaps. A copy quality defect results.

That acoustic agitation or vibration of a surface can enhance toner release therefrom is known. Resonators coupled to the charge retentive surface of an electrophotographic device at various stations therein, for the purpose of enhancing the electrostatic function, are known, as in: U.S. Pat. No. 5,210,577 to Nowak; U.S. Pat. No. 5,030,999 to Lindblad et al.; U.S. Pat. No. 5,005,054, to Stokes et al.; U.S. Pat. No. 5,010,369 to Nowak et al.; U.S. Pat. No. 5,025,291 to Nowak et al.; U.S. Pat. No. 5,016,055 to Pietrowski et al.; U.S. Pat. No. 5,081,500 to Snelling; U.S. Pat. No. 5,282,005 to Nowak, et al.; and U.S. Pat. No. 5,329,341 to Nowak, et al.

In the ultrasonic welding horn art, as exemplified by U.S. Pat. No. 4,363,992 to Holze, Jr., where blade-type welding horns are used for applying high frequency energy to surfaces, it is known that the provision of slots through the horn perpendicular to the direction in which the welding horn extends, reduces undesirable mechanical coupling of effects across the contacting horn surface. Accordingly, in such art, the contacting portion of the horn is maintained as a continuous surface, the horn portion is segmented into a plurality of segments, and the horn platform, support and piezoelectric driver elements are maintained as continuous members. For uniformity purposes, it is desirable to segment the horn so that each segment acts individually.

U.S. Pat. No. 4,713,572 to Bokowski, teaches the use of adhesive in adhering a horn to a piezoelectric element. In U.S. patent application Ser. No. 07/620,520, "Energy Transmitting Horn Bonded to an Ultrasonic Transducer for Improved Uniformity at the Horn Tip", by R. Stokes et al. teaches the use of an epoxy mesh which serves to bond ceramic piezoelectric elements to the surface of the horn as well as provide electrical contact for the A.C. drive voltage to excite the elements. The epoxy mesh behaves as a low pass mechanical filter, attenuating the transfer of energy from the active element to the waveguide. Variations in dimensions of the epoxy mesh, surface finish, and localized pressure during assembly process influence the coupling between the piezoelectric element and the waveguide resulting in nonuniform vibration amplitude across the process width.

An object of the present invention is to produce a simple, relatively inexpensive yet accurate approach to assemble ceramic piezoelectric elements adhesively to a horn, which improves the transducer uniformity of vibration; this has been a goal in the design, and manufacture of such devices.

SUMMARY OF THE INVENTION

In accordance with the invention there is provided an apparatus fabricating a resonator including a horn member and a plurality of piezoelectric members which are secured together by an adhesive layer, including a support element for holding said horn securely in place; and a plurality of clamping bars for applying a discrete force to each one of said plurality of piezoelectric members, each one of said plurality of clamping bars is in contact and associated with an individual piezoelectric member from said plurality of piezoelectric elements thereby maintaining a substantially uniform adhesive layer thickness between said horn and each of one said plurality of piezoelectric members. In one embodiment a pneumatic force application system connected to each one of said plurality of clamping bars for supplying said discrete uniform force to each one of said plurality of clamping bars, said pneumatic force application system includes a plurality of air cylinders, each of said plurality of air cylinders having a force applicator connected to each one of said plurality of clamping bars, a common air tank connected in parallel with each of said plurality of air cylinders to provide a common air pressure to each of said plurality of air cylinders. In other embodiments the force application system may be entirely mechanical, such as a series of precalibrated springs, likewise, discretely providing the uniform force.

These and other aspects of the invention will become apparent from the following description used to illustrate a preferred embodiment of the invention read in conjunction with the accompanying drawings in which.

Printing machines of the type contemplated for use with the present invention are well known and need not be described herein. U.S. Pat. No. 5,210,577 to Nowak; U.S. Pat. No. 5,030,999 to Lindblad et al.; U.S. Pat. No. 5,005,054 to Stokes et al.; U.S. Pat. No. 4,987,456 to Snelling et al.; U.S. Pat. No. 5,010,369 to Nowak et al.; U.S. Pat. No. 5,025,291 to Nowak et al.; U.S. Pat. No. 5,016,055 to Pietrowski et al.; U.S. Pat. No. 5,081,500 to Snelling; U.S. Pat. No. 5,282,005 to Nowak, et al.; U.S. Pat. No. 5,329,341 to Nowak et al.; and U.S. patent application Ser. No. 07/620,520, "Energy Transmitting Horn Bonded to an Ultrasonic Transducer for Improved Uniformity at the Horn Tip", by R. Stokes et al. adequately describes such devices, and the application of transfer improving vibration inducing devices, and are specifically incorporated herein by reference.

Figure 1:
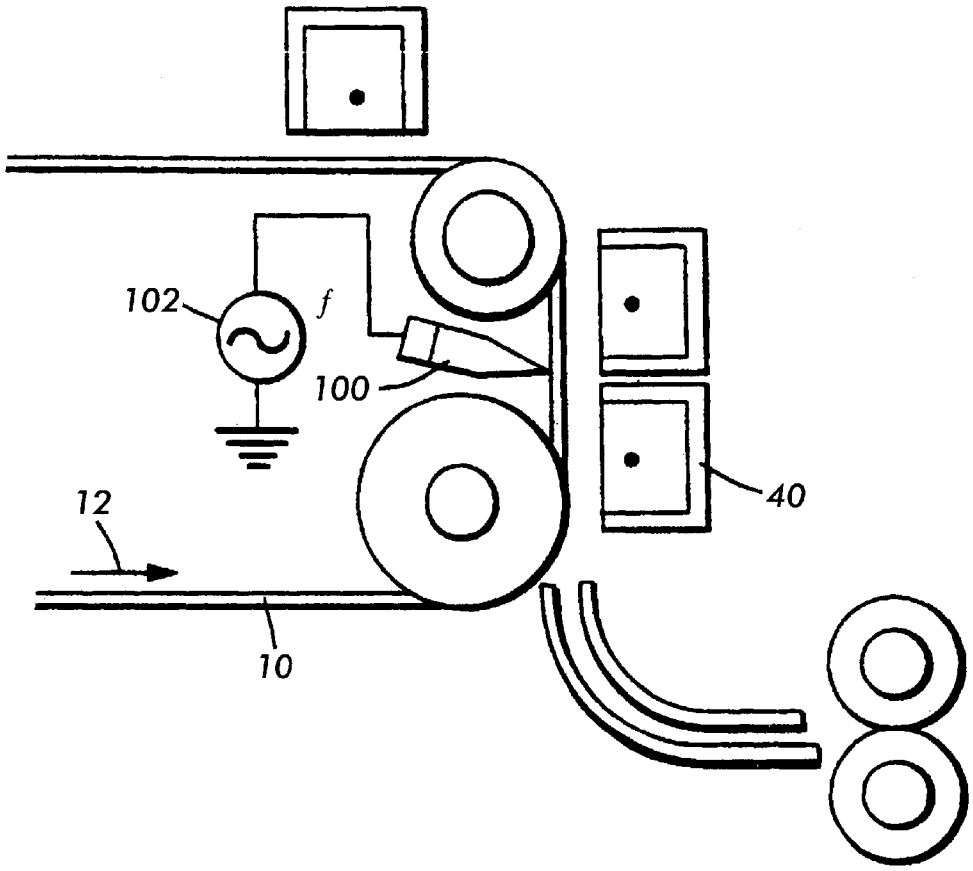
FIG. 1 is a schematic elevational view of a printing machine transfer station and the associated ultrasonic transfer enhancement device of the invention.

With reference to FIG. 1, wherein a portion of a printing machine is shown including at least portions of the transfer, detack and precleaning functions thereof, the basic principle of enhanced toner release is illustrated, where a relatively high frequency acoustic or ultrasonic resonator 100 driven by an A.C. source 102 operated at a frequency f between 20 kHz and 200 kHz, is arranged in vibrating relationship with the interior or backside of an image receiving belt 10, at a position closely adjacent to where the belt passes through a transfer station. Vibration of belt 10 agitates toner developed in imagewise configuration onto belt 10 for mechanical release thereof from belt 10, allowing the toner to be electrostatically attracted to a sheet during the transfer step, despite gaps caused by imperfect paper contact with belt 10.

Additionally, increased transfer efficiency with lower transfer fields than normally used appears possible with the arrangement. Lower transfer fields are desirable because the occurrence of air breakdown (another cause of image quality defects) is reduced. Increased toner transfer efficiency is also expected in areas where contact between the sheet and belt 10 is optimal, resulting in improved toner use efficiency, and a lower load on the cleaning system.

In a preferred arrangement, the resonator 100 is arranged with a vibrating surface parallel to belt 10 and transverse to the direction of belt movement 12, generally with a length approximately co-extensive with the belt width. The belt described herein has the characteristic of being non-rigid, or somewhat flexible, to the extent that it can be made to follow the resonator vibrating motion. One type of photoconductive imaging member is typically multi-layered and has a substrate, a conductive layer, an optional adhesive layer, an optional hole blocking layer, a charge generating layer, a charge transport layer, and, in some embodiments, an anti-curl backing layer.

Figure 2:
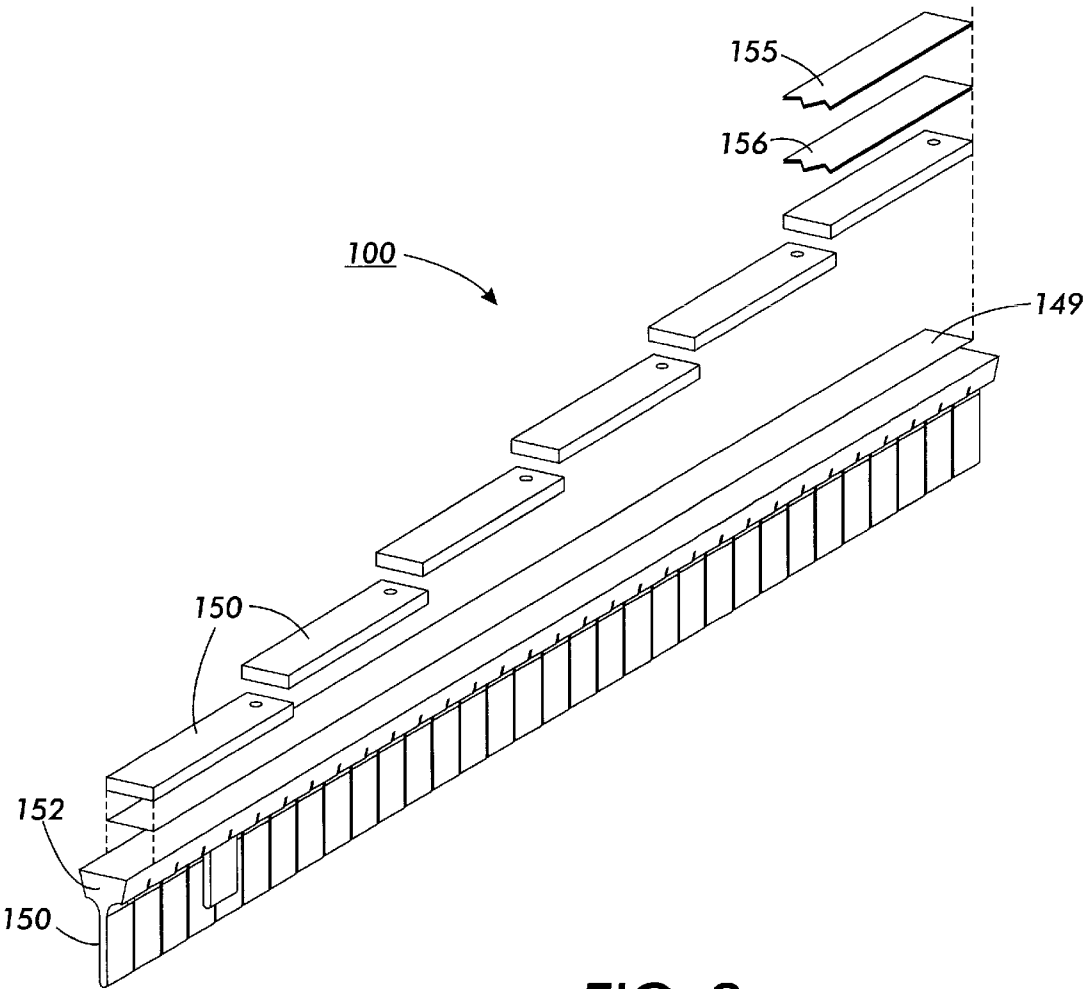
FIG. 2 is a sectional elevational view of one embodiment of the ultrasonic resonator.

With reference to FIG. 2, the vibratory energy of the resonator 100 may be coupled to belt 10 in a number of ways. In the arrangements shown, resonator 100 comprises piezoelectric transducer elements 150 and horn 152. A desirable material for the horn is aluminum. The piezoelectric transducer element 150 is adhesively attached onto horn 152 on base 156.

The piezoelectric transducer element 150 comprises a piezoelectric active ceramic material, such as lead zirconate titinate (PZT), barium titinate ($BaTiO_3$), or lead titinate ($PbTiO_3$). Alternatively, other materials might include an active polymer, such as polyvinyidene flouride (PVDF), copolymers of vinylidene flouride and triflouroethylene (P(VDF/TrFe)) or vinylidene flouride and tetraflouroethane (P(VDF/TeFe)), or composite materials comprising a piezoelectric active ceramic particulate material in a polymeric binder.

The piezoelectric elements 150 are bonded with an adhesive 149 to horn 152. Obviously, a vast array of adhesives such as transfer adhesives, epoxies, cyanoacrylates, or an epoxy/conductive mesh layer may be used to bond the horn and piezoelectric polymer element together.

Figure 6:
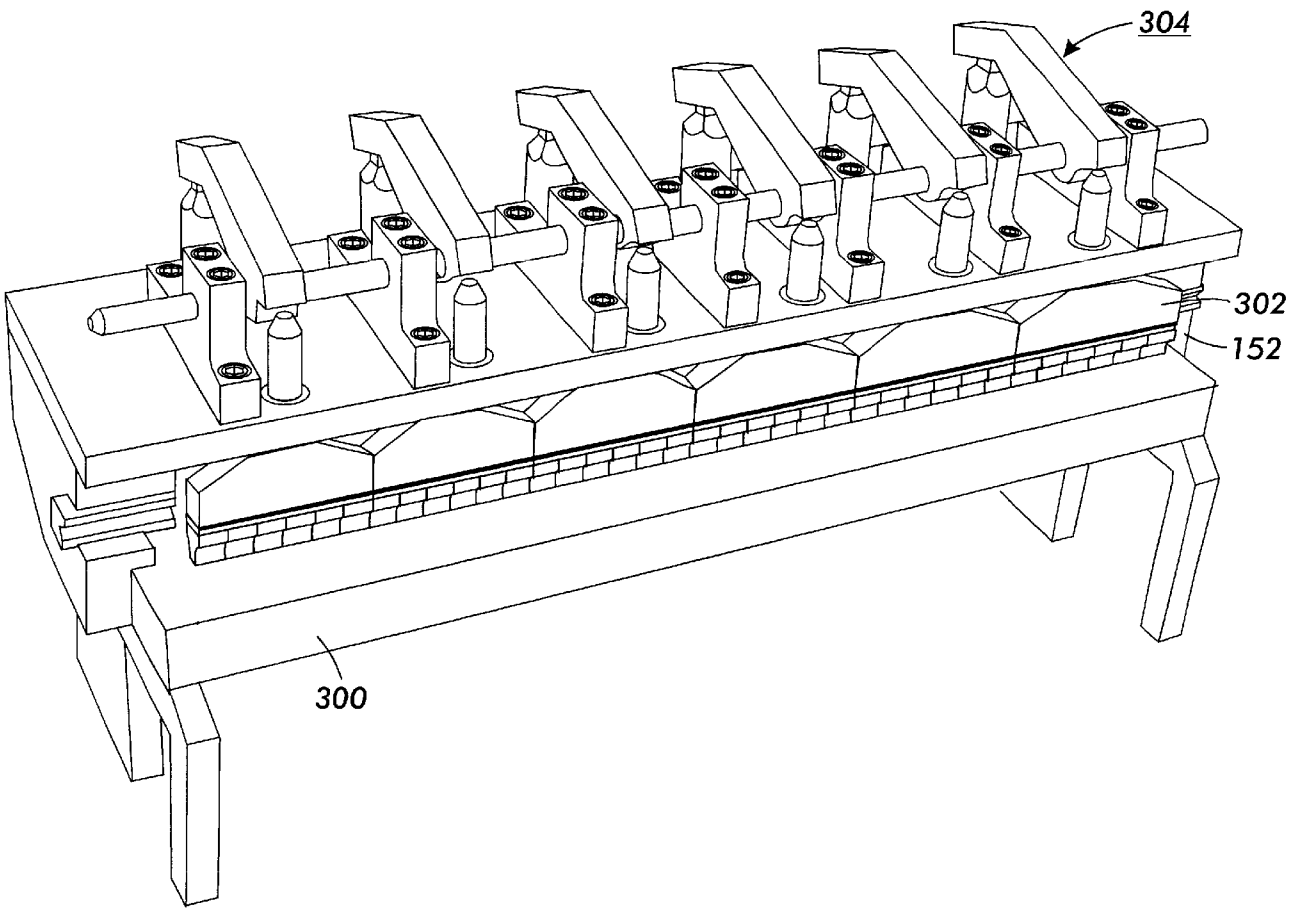

Now referring to FIGS. 2–6, the assembly apparatus of the present invention is shown in FIG. 6, support element 300 holds horn 152 securely in place. Next, a layer of adhesive (149) is applied to horn 152. Then, piezoelectric elements 150 are placed along horn 152. Another layer of adhesive 156 is applied to piezoelectric elements 150. A thin, flexible conductive back electrode 155 is then placed on top. Clamping bars 302 are placed in contact with each piezoelectric elements 150. Each clamping bars 302 has the approximate dimension as each piezoelectric elements 150. Force applicators 304 via clamping bars applies a discrete uniform force against each piezoelectric elements 150. In the preferred embodiment of the invention air pressure is used to transfer force to force applicators 304. Air is supplied to a common tank 306 wherein constant air pressure is maintained, typically from 20 to 100 psi, depending on the air cylinder bore diameter; each force applicator is individually supplied from the common tank 306 by air cylinders 308 each associated with a single force applicator 304.

Applicant has found this arrangement highly desirable because the fabrication process of the transducer is critical to its performance. For the transducer to operate properly and within specification, currently 600 mm/sec +/−20%, it must posses one resonant frequency. For this to occur, the bond layer between the pzt and the waveguide needs to be of uniform thickness along the full length of the transducer. The difficulty in maintaining this, is the fact that there exists a finite tolerance on the pzt thickness. Therefore, when the pzt elements are bonded to the waveguide base surface, they need to be biased against the waveguide base independently of the adjacent elements to either side.

Also, because the conductive mesh, used to maintain uniform thickness and serves as the negative electrode, is somewhat compressible, the clamping force needs to be uniform from element to element.

The reason the bond layer thickness uniformity is of such significance with respect to singular resonance (monomodal) response, is two-fold. First, and most importantly, because the bond layer has the lowest modulus of elasticity (highest damping) its contribution to the transmittance of ultrasonic energy from the pzt to the waveguide tip is the greatest. Therefore, if the bond layer, presently 150 microns, varies from element to element, by as little as 25 microns, shifts in frequency response and amplitude are significant. Secondly, the overall composite height of the transducer, primarily from the tip to the generating element (pzt), dictates the transducers resonant frequency.

Figure 3:
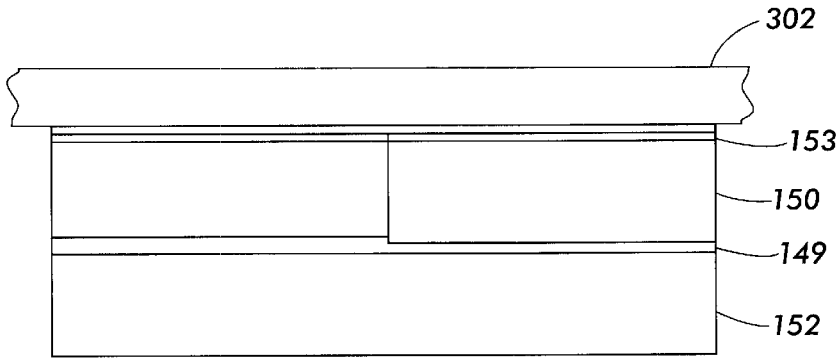
FIGS. 3–6 illustrate the assembly apparatus of the present invention.
Figure 4:
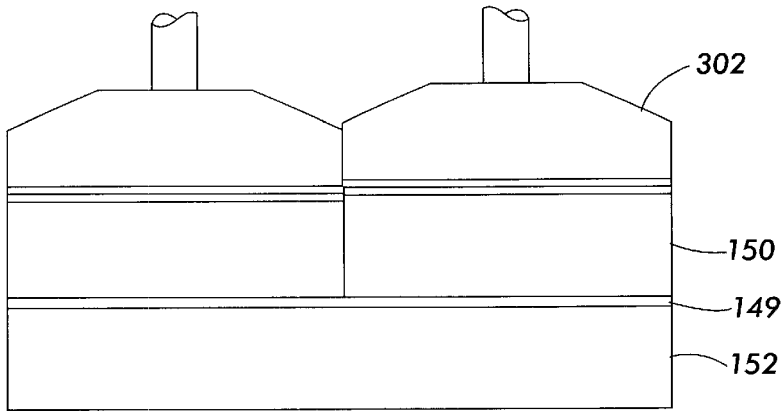
Figure 5:
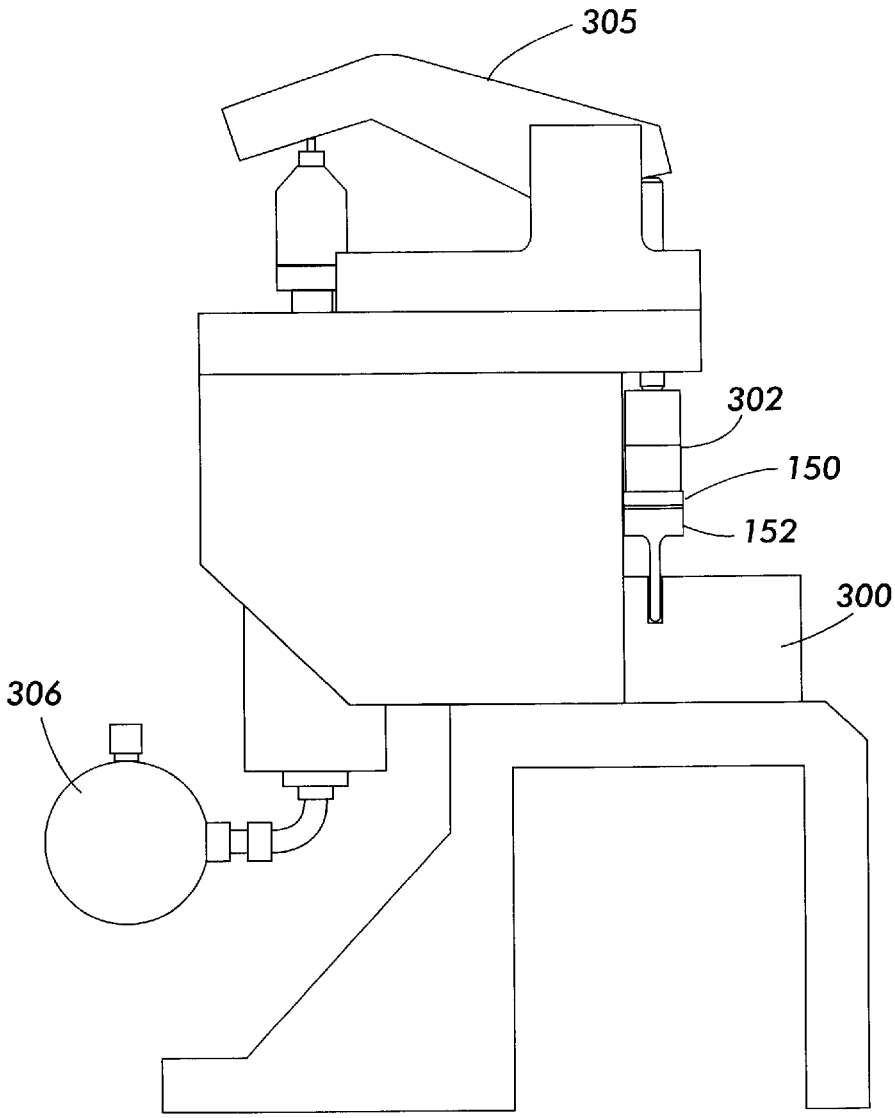

To visualize the shortcomings of not using discrete clamping, refer to FIG. 3. Imagine a thin pzt element (150) adjacent to one, or two, thicker elements with a continual back plate pressing the elements (and back electrode 155) against the waveguide. The thin element would be allowed to "float" within the two bond layers. Thereby not maintaining the "critical" bond layer thickness between the pzt and the waveguide. Now imagine the same scenario yet using discrete clamping, as shown in FIG. 4. The "critical" bond layer thickness is maintained.

The other key aspect of this assembly method is ensuring uniform clamping force on each of the discrete anvils. By doing this, the conductive mesh or similar conductive spacer is able to maintain a uniform thickness.

This embodiment is but one example, and various alternatives, modifications, variations or improvements may be made by those skilled in the art from this teaching which are intended to be encompassed by the following claims.

I claim:

1. An apparatus for fabricating a resonator including a horn member and a plurality of piezoelectric members which are secured together by an adhesive layer, comprising:

a support element for holding said horn securely in place; and a plurality of clamping bars for applying a discrete force to each one of said plurality of piezoelectric members, each one of said plurality of clamping bars being in contact and associated with an individual piezoelectric member from said plurality of piezoelectric members thereby maintaining a substantially uniform adhesive layer thickness between said horn and each of one said plurality of piezoelectric members.

2. The apparatus of claim 1, further comprising a pneumatic force application system connected to each one of said plurality of clamping bars for supplying said discrete uniform force to each one of said plurality of clamping bars, said pneumatic force application system including a plurality of air cylinders, each of said plurality of air cylinders having a force applicator being connected to each one of said plurality of clamping bars, a common air tank connected in parallel with each of said plurality of air cylinders to provide a common air pressure to each of said plurality of air cylinders.

3. A method for fabricating a resonator for applying vibrational energy to a member comprising the steps of:

providing a horn member;

securing a plurality of piezoelectric members to a surface of the horn member; said securing step comprises depositing an adhesive layer to said horn member; and applying a discrete force to each one of said plurality of piezoelectric members to maintain a predefined uniform thickness of said adhesive layer between said horn and each piezoelectric member.

* * * * *